US007794099B2

(12) United States Patent
Wang et al.

(10) Patent No.: US 7,794,099 B2
(45) Date of Patent: Sep. 14, 2010

(54) LED LAMP

(75) Inventors: Zhong-Qing Wang, Shenzhen (CN); Xiu-Yi Zhang, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 30 days.

(21) Appl. No.: 12/241,061

(22) Filed: Sep. 30, 2008

(65) Prior Publication Data

US 2009/0323328 A1 Dec. 31, 2009

(30) Foreign Application Priority Data

Jun. 25, 2008 (CN) ..... 2008 1 0068111

(51) Int. Cl.
*F21V 7/00* (2006.01)

(52) U.S. Cl. ..... 362/97.3; 362/613; 362/632; 362/97.1; 362/249.02

(58) Field of Classification Search ..... 362/800, 362/600–632, 97.1–97.3, 6, 12, 613, 97.4, 362/615, 616
See application file for complete search history.

(56) References Cited

U.S. PATENT DOCUMENTS

| | | | | |
|---|---|---|---|---|
| 7,287,891 | B1 * | 10/2007 | Park et al. | 362/555 |
| 7,399,995 | B2 * | 7/2008 | Yu | 257/98 |
| 7,407,316 | B2 * | 8/2008 | Noh et al. | 362/612 |
| 7,470,046 | B2 * | 12/2008 | Kao et al. | 362/332 |
| 7,661,862 | B2 * | 2/2010 | Lee et al. | 362/559 |
| 2005/0276075 | A1 * | 12/2005 | Chen et al. | 362/615 |
| 2006/0232964 | A1 * | 10/2006 | Hoshi et al. | 362/231 |
| 2007/0253219 | A1 * | 11/2007 | Kim et al. | 362/612 |

* cited by examiner

*Primary Examiner*—Anabel M Ton
(74) *Attorney, Agent, or Firm*—Frank R. Niranjan

(57) ABSTRACT

An LED lamp includes a base plate, a plurality of LED components fixed on the base plate in lines and a light-guiding module located over the LED components. The light-guiding module has a plurality of light-reflecting bars mounted above the LED components. Each of the light-guiding bars is in alignment with a line of the LED components and has a thickness gradually decreasing toward the line of the LED components.

18 Claims, 3 Drawing Sheets

LED LAMP

BACKGROUND OF THE INVENTION

1. Field of the Invention

The present invention relates to an LED lamp for a lighting purpose, and more particularly to an improved LED lamp capable of providing a broad illuminating area.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Known implementations of LED modules in an LED lamp make use of a plurality of individual LEDs to generate light that is sufficient and of satisfactory spatial distribution. The large number of LEDs leads to a more expensive module and one with greater power consumption. The greater power usage leads to greater heat output, which, if not adequately addressed at additional expense, impacts the LED lamp reliability.

Besides, since the LEDs are generally arranged on a printed circuit board having a flattened surface, the LEDs acting as a light source and arranged in this way usually distributes lamplight in every spatial angle with sharp different intensity and brightness, whereby the LED lamp with the LEDs arranged on the flattened surface is failed to provide a satisfactory illumination which suits for a condition needing an even and broad illumination.

What is needed, therefore, is an improved LED lamp which can overcome the above problems.

SUMMARY OF THE INVENTION

An LED lamp includes a base plate, a plurality of LED components fixed on the base plate in lines and a light-guiding module mounted over the LED components. The light-guiding module has a plurality of light-reflecting bars mounted above the LED components. Each of the light-guiding bars is in alignment with a corresponding line of the LED components and has a thickness gradually decreasing toward the corresponding line of the LED components.

Other advantages and novel features will become more apparent from the following detailed description of preferred embodiments when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
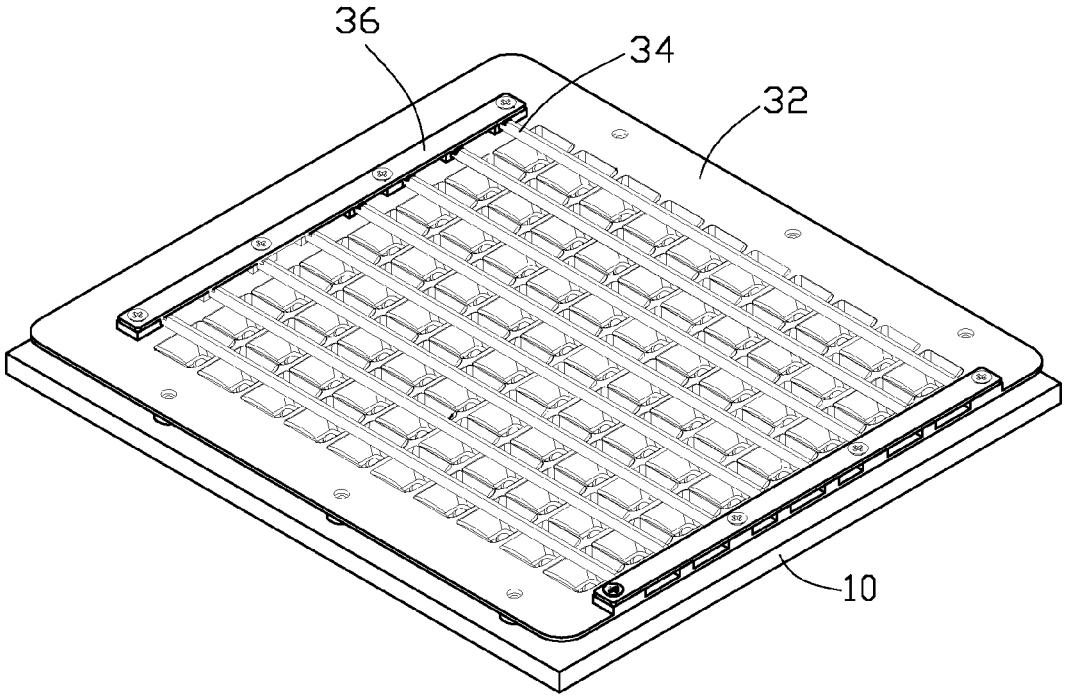
FIG. 1 is an isometric, assembled view of an LED lamp in accordance with a preferred embodiment of the present invention.
Figure 2:
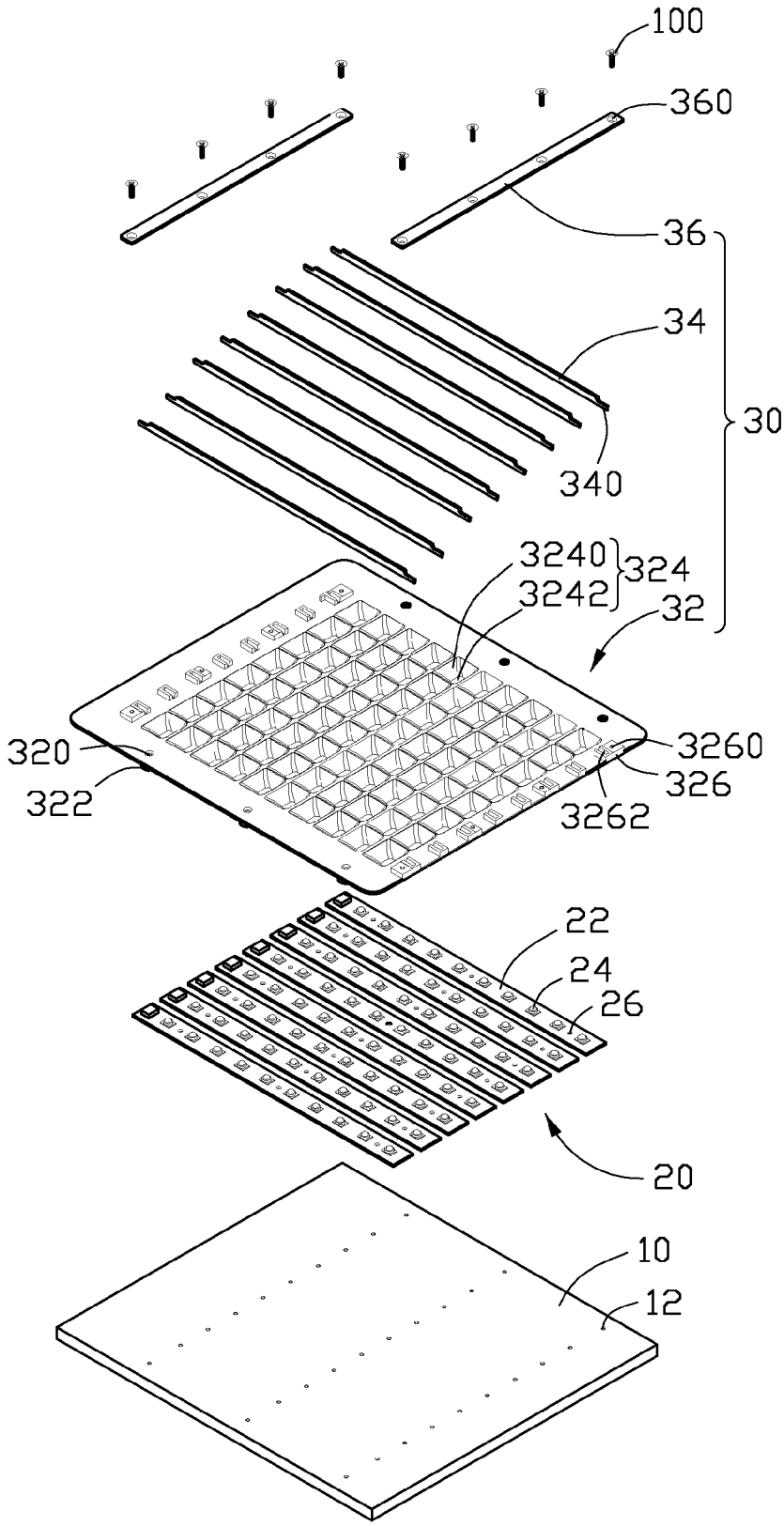
FIG. 2 is an exploded view of FIG. 1.
Figure 3:
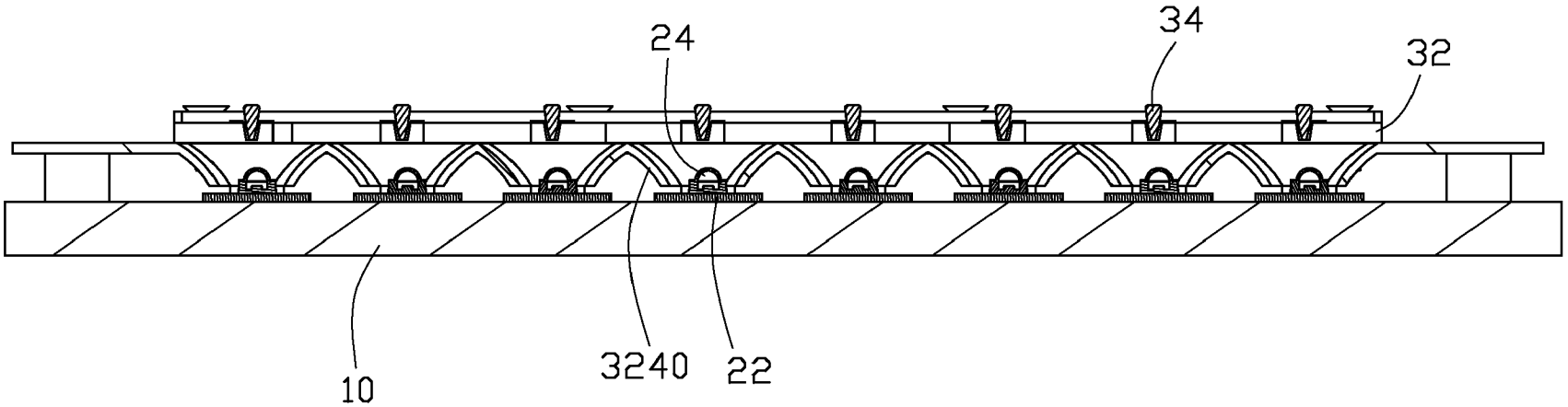
FIG. 3 is a cross-section view of FIG. 1.

Referring to FIGS. 1-3, an LED lamp in accordance with a preferred embodiment is illustrated. The LED lamp is configured for providing illumination in home or outdoor locale and comprises a base plate 10, a plurality of LED modules 20 fixed to a top surface of the base plate 10 and a light-guiding module 30 mounted over the LED modules 20.

The base plate 10 made of a material with high heat conductivity is rectangular and defines a plurality of fixing holes 12 in lines therein. Each line of the fixing holes 12 has three fixing holes 12 and is arranged in a linear direction parallel to two opposite sides of the base plate 10 for mounting a corresponding LED module 20 on the base plate 10.

The LED modules 20 are arranged side by side on the base plate 10 and each comprise an elongated printed circuit board 22 and a plurality of LED components 24 arranged in a line on a corresponding printed circuit board 22 along a length thereof. A plurality of extending holes 26 are defined in the printed circuit boards 22 in a line, and arranged corresponding to the fixing holes 12 of the base plate 10 for extension of screws (not shown) there through to engage into the fixing holes 12 of the base plate 10 to securely mount the LED modules 20 on the base plate 10.

The light-guiding module 30 comprises a main body 32 located over the LED modules 20, a plurality of light reflecting bars 34 fixed on a top face of the main body 32 and two retaining strips 36 cooperating with the main body 32 to clamp two opposite ends of the light reflecting bars 34 there between. The main body 32 is rectangular plate-shaped and has an area substantially the same as that of the base plate 10. The main body 32 defines a plurality of light-guiding cups 324 embedded therein in a plurality of lines and has a plurality of mounting blocks 326 protruding upwardly from a top surface of the main body 32 and located adjacent to two opposite sides of the main body 32. The main body 32 has a plurality of retaining posts 322 extending downwardly from a bottom surface thereof and located adjacent to the other two opposite sides of the main body 32. The retaining posts 322 each define a piercing hole 320 therein, for extension of screws (not shown) there through to screw into the base plate 10 to secure the light-guiding module 30 onto the base plate 10.

Each line of the light-guiding cups 324 is corresponding to one of the LED modules 20 and has a plurality of light-guiding cups 324 respectively in alignment with the LED components 24 mounted on the LED module 20. Each of the light-guiding cups 324 has four inclined interior faces 3240 interconnecting with each other and is recessed downwardly towards the base plate 10 to define a rectangular opening 3242 in a bottom end thereof. Each of the LED components 24 extending through the opening 3242 is upwardly extended into a corresponding light-guiding cup 324, and the bottom ends of the light-guiding cups 324 press downwardly against top surfaces of the printed circuit boards 22 of the LED modules 20. Each of the mounting blocks 326 is recessed downwardly from a top surface to define a receiving slot 3262 for receiving an end of a corresponding light-guiding bar 34. The receiving slot 3262 extends inwardly through an inner edge of each of the mounting blocks 326. Some of he mounting blocks 326 which are spaced from each other have laterally extended portions (not labeled) each defining an engaging hole 3260 in the top surface thereof for securing the retaining strips 36 thereon.

Each of the light-reflecting bars 34 spanning lengthways over one of the LED modules 20 is recessed downwardly at two opposite ends thereof to define two inserting parts 340.

The two inserting parts 340 of each of the light-reflecting bars 34 are fitly received in one corresponding pair of receiving slots 3262 in the corresponding mounting blocks 326 and have top surfaces coplanar with top surfaces of the mounting blocks 326 so as to support the retaining strips 36 thereon. Each of the light-reflecting bars 34 is located above a corresponding LED module 20 and in alignment with the LED components 24 of the corresponding LED module 20. The light-reflecting bar 34 has a gradually decreased thickness in a direction from a top thereof towards the corresponding LED component 24; thus the light-reflecting bars 34 each define two inclined lateral faces at two opposite lateral sides thereof, and are wedge-shaped in cross section thereof. Alternatively, the light-reflecting bar 34 can have a cross section which is inverted triangle-shaped or inverted trapezium-shaped.

The two mounting strips 36 are fixed on the mounting blocks 326 and press on the tops of the inserting parts 340 of the light-reflecting bars 34. A plurality of through holes 360 are defined in the mounting strips 36 to respectively receive a plurality of fixtures 100. The fixtures 100 are screwed into the engaging holes 3260 of the mounting blocks 326 of the main body 32 to securely hold the light-guiding bars 34 in the receiving slots 3262 of the mounting blocks 326.

In use of the LED lamp, the two inclined lateral faces of each of the light-reflecting bars 34 are arranged in a predetermined angle relative to the top surface of the base plate 10 on which the LED modules 20 are mounted, whereby light generated by the LED components 24 of the LED modules 20 is partially reflected by the inclined lateral faces of the corresponding light-reflecting bars 34. Thus light from the LED module 20 would not mainly focus at a middle portion of an illuminating area, but is evenly distributed all over the illuminating area.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a base plate;

a plurality of LED components fixed on the base plate in lines; and a light-guiding module located over the LED components and having a plurality of light-reflecting bars mounted above the LED components;

wherein each of the light-guiding bars is mounted over and in alignment with a corresponding line of the LED components, each of the light-guiding bars comprises a bottom end near the corresponding line of the LED components and a top end remote from the corresponding line of the LED components, and each of the light-guiding bars has a thickness gradually decreased from the top end to the bottom end.

2. The LED lamp as claimed in claim 1, wherein each of the light-reflecting bars defines two inclined face at a predetermined angle relative to a top surface of the base plate on which the LED components are mounted.

3. The LED lamp as claimed in claim 1, wherein a cross section of each of the light-reflecting bars is one of wedge-shaped, inverted triangle-shaped and inverted trapezium-shaped.

4. The LED lamp as claimed in claim 1, wherein the light-guiding module comprises a main body and a plurality of light-guiding cups in lines extending downwardly from the main body and respectively receiving the LED components.

5. The LED lamp as claimed in claim 4, wherein each of the light-guiding cups has four inclined interior faces interconnecting with each other and extending downwardly from the main body to cooperatively define a rectangular opening in a bottom end thereof, the LED components extending through the openings into the light-guiding cups.

6. The LED lamp as claimed in claim 5, wherein the light-guiding cups are located between the light-reflecting bars and the LED components.

7. The LED lamp as claimed in claim 1, wherein the main body has a plurality of mounting blocks protruding upwardly from a top surface of the main body and located at two opposite sides of the LED components, and each of the mounting blocks is recessed downwardly from a top surface thereof to define a receiving slot to receive an end of the each of the light-guiding bars therein, the receiving slot extending inwardly through an inner edge of the each of the mounting blocks.

8. The LED lamp as claimed in claim 7, wherein each of the light-reflecting bars is recessed downwardly from top surfaces of two opposite end portions to define two inserting parts which are fitly received in a pair of receiving slots in corresponding mounting blocks and have top surfaces coplanar with top surfaces of the corresponding mounting blocks.

9. The LED lamp as claimed in claim 7, further comprising two retaining strips respectively fixed on the top surfaces of the mounting blocks at the two opposite sides of the LED components to thus lock the opposite ends of the light-reflecting bars in the receiving slots.

10. The LED lamp as claimed in claim 1, further comprising a plurality of printed circuit boards mounted on the base plate, and the LED components are mounted on the printed circuit boards.

11. An LED lamp, comprising:

a base plate;

a plurality of LED modules mounted side by side on the base and each comprising an elongated printed circuit board and a plurality of LED components arranged on the printed circuit board in a linear way along a length of the printed circuit board; and a light-guiding module mounted over the LED modules and having a plurality of light-reflecting bars respectively located above the LED modules;

wherein each of the light-guiding bars is arranged in alignment with the LED components mounted on the printed circuit board of a corresponding LED module and has a thickness gradually decreasing toward the LED components.

12. The LED lamp as claimed in claim 11, wherein each of the light-reflecting bars defines two inclined faces at a predetermined angle to a top surface of the base plate on which the LED components are mounted.

13. The LED lamp as claimed in claim 11, wherein a cross section of each of the light-reflecting bars is one of wedge-shaped, inverted triangle-shaped and inverted trapezium-shaped.

14. The LED lamp as claimed in claim 11, wherein the light-guiding module comprises a main body and a plurality of light-guiding cups extending downwardly from the main body in lines and respectively receiving the LED components.

15. The LED lamp as claimed in claim 14, wherein each of the light-guiding cups has four inclined interior faces interconnecting with each other and extending downwardly from the main body to cooperatively define a rectangular opening in a bottom end thereof, through the opening a corresponding LED component is upwardly extended into the a corresponding light-guiding cup.

16. The LED lamp as claimed in claim 15, wherein the light-guiding cups press downwardly against the printed circuit board.

17. The LED lamp as claimed in claim 11, wherein the main body has a plurality of mounting blocks protruding upwardly from a top surface of the main body and located at two opposite sides of the LED modules, and each of the mounting blocks is recessed downwardly from a top surface thereof to define a receiving slot receiving an end of a corresponding light-guiding bar.

18. The LED lamp as claimed in claim 17, wherein each of the light-reflecting bars is recessed downwardly from top surfaces of two opposite end portions thereof to define two inserting parts each of which is received in a corresponding slot.

* * * * *